US010476149B1

(12) United States Patent
Ueda

(10) Patent No.: US 10,476,149 B1
(45) Date of Patent: Nov. 12, 2019

(54) ARRAY ANTENNA

(71) Applicant: Murata Manufacturing Co., Ltd., Kyoto (JP)

(72) Inventor: Hideki Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/118,623

(22) Filed: Aug. 31, 2018

Related U.S. Application Data

(63) Continuation of application No. PCT/JP2017/003515, filed on Feb. 1, 2017.

(30) Foreign Application Priority Data

Mar. 4, 2016 (JP) ..... 2016-042083

(51) Int. Cl.
*H01Q 1/38* (2006.01)
*H01Q 1/24* (2006.01)

(52) U.S. Cl.
CPC ..... *H01Q 1/38* (2013.01); *H01Q 1/24* (2013.01)

(58) Field of Classification Search
CPC ..... H01Q 1/38; H01Q 1/243; H01Q 1/24
USPC ..... 343/700 MS
See application file for complete search history.

(56) References Cited

U.S. PATENT DOCUMENTS 4,367,474 A * 1/1983 Schaubert ..... H01Q 3/44 343/700 MS
7,773,035 B2 * 8/2010 Murata ..... H01Q 3/24 343/700 MS
7,864,117 B2 * 1/2011 Aurinsalo ..... H01Q 21/065 343/700 MS
8,400,269 B2 * 3/2013 Tuttle ..... G06K 7/10316 340/10.1
8,508,426 B2 * 8/2013 Honda ..... H01Q 3/44 343/700 MS
2008/0088510 A1 * 4/2008 Murata ..... H01Q 3/24 343/700 MS (Continued)

FOREIGN PATENT DOCUMENTS

JP H05-160627 A 6/1993
JP 2002-330024 A 11/2002

(Continued)

OTHER PUBLICATIONS

International Search Report for International Application No. PCT/JP2017/003515, dated Feb. 28, 2017.

(Continued)

*Primary Examiner* — Huedung X Mancuso
(74) *Attorney, Agent, or Firm* — Pearne & Gordon LLP

(57) ABSTRACT

A plurality of fed elements arranged in a first direction is provided within the plane of a substrate. A plurality of non-fed elements is provided to sandwich at least one of the plurality of fed elements. The plurality of non-fed elements are loaded to the plurality of fed elements. At least one of the plurality of non-fed elements is provided between two of the plurality of fed elements arranged in the first direction. The at least one of the plurality non-fed elements is shared by the two of the plurality of non-fed elements that are adjacent to each other in the first direction. This configuration provides an array antenna that is suited for miniaturization and capable of achieving increased beam scanning angle.

4 Claims, 12 Drawing Sheets

(56) References Cited

U.S. PATENT DOCUMENTS

| | | | | |
|---|---|---|---|---|
| 2009/0322642 | A1* | 12/2009 | Foo | H01Q 1/42<br>343/843 |
| 2011/0102287 | A1* | 5/2011 | Noguchi | H01Q 21/065<br>343/833 |
| 2011/0109524 | A1* | 5/2011 | Saily | H01Q 21/08<br>343/893 |
| 2014/0266957 | A1 | 9/2014 | Inoue | |

FOREIGN PATENT DOCUMENTS

| | | | |
|---|---|---|---|
| JP | 2003-142919 | A | 5/2003 |
| JP | 2008-048109 | A | 2/2008 |
| JP | 2013-168875 | A | 8/2013 |
| WO | 2006/035881 | A1 | 4/2006 |
| WO | 2010/004739 | A1 | 1/2010 |

OTHER PUBLICATIONS

Written Opinion for International Application No. PCT/JP2017/003515, dated Feb. 28, 2017.

* cited by examiner

ARRAY ANTENNA

This is a continuation of International Application No. PCT/2017/003515 filed on Feb. 1, 2017 which claims priority from Japanese Patent Application No. 2016-042083 filed on Mar. 4, 2016. The contents of these applications are incorporated herein by reference in their entireties.

BACKGROUND

Technical Field

The present disclosure relates to an array antenna including plural fed elements, and plural non-fed elements loaded to the fed elements.

General patch antennas are convenient for implementation in or on a substrate, with an added advantage of providing high gain. Such patch antennas, however, have narrow band widths, and are not suited for achieving increased band widths. By loading a fed element of such a patch antenna with non-fed elements (parasitic elements) to generate multi-resonance, it is possible to increase the band width of the patch antenna.

A slot antenna is disclosed in Patent Document 1 described below. A ground plate on one side of a double-sided printed circuit board is provided with plural slits. A microstrip line is located on the other side of the double-sided printed circuit board. Among the plural slits, desired slits are used as driven slits, with the remaining slits serving as parasitic slits. A conductor plate is placed at a given spacing from the double-sided printed circuit board. Radiated waves radiated from the driven slits, and reflected waves reflected by the conductor plate are enhanced at the location of the driven slits. Further, the reflected waves resonate at the location of the parasitic slits and re-radiated. The presence of the parasitic slits contributes to increased antenna gain.

Patent Document 2 described below discloses a patch antenna including a fed element, and two non-fed elements provided on both sides of the fed element. A transmission line is connected to each non-fed element. A radio frequency switch is provided at a point in the transmission line. Each non-fed element acts as a waveguide when the radio frequency switch is in one of its ON and OFF states. This allows for easy control of the radiation pattern.

Patent Document 3 described below discloses an array antenna including wide-angle antennas arranged in a line. Each wide-angle antenna includes a fed element, and non-fed elements provided in a direction orthogonal to the direction of excitation of the fed element. The wide-angle antennas are arrayed in a direction parallel to the direction of excitation of the fed element. That is, the non-fed elements are provided on both sides of the fed elements arranged in a line.

Patent Document 1: Japanese Unexamined Patent Application Publication No. 2002-330024

Patent Document 2: Japanese Unexamined Patent Application Publication No. 2008-48109

Patent Document 3: Japanese Unexamined Patent Application Publication No. 2013-168875

BRIEF SUMMARY

An array antenna is made up of an array of patch antennas each having non-fed elements provided on both sides of a fed element within the plane of a substrate. If such patch antennas are arrayed in a direction in which the driven and non-fed elements are arranged side by side, the respective non-fed elements of two adjacent patch antennas are provided between the respective fed elements of the two patch antennas. This configuration makes it difficult to place fed elements close to each other, resulting in a rather large array size. Further, the resulting increase in the period of array of the patch antennas reduces the angle of beam scanning provided by phase control.

The configuration of the slot antenna disclosed in Patent Document 1 requires that the conductor plate acting as a reflector plate be spaced from the ground plate provided with the slits. This requirement makes the slot antenna unsuitable for achieving reduced antenna thickness. Another problem with the above configuration is that the presence of the parasitic slits, although contributing to increased antenna gain, does not increase the operating band width of the antenna. Consequently, the above configuration may fail to achieve a sufficient increase in band width.

With the patch antenna disclosed in Patent Document 2, the radiation pattern can be controlled by switching the ON and OFF states of the radio frequency switch. However, unlike phased array antennas, this patch antenna lacks the capability to perform beamforming by providing phase differences to signals applied to plural fed elements.

With the array antenna disclosed in Patent Document 3, each one fed element is loaded with two non-fed elements. This makes it necessary to place three times as many conductor patterns as the number of unit elements that make up the array antenna. This requirement makes it difficult to reduce the area of the array antenna.

The present disclosure provides an array antenna that is suited for miniaturization and capable of providing increased beam scanning angle.

According to a first aspect of the present disclosure, there is provided an array antenna including a plurality of fed elements provided on or in a substrate, the plurality of fed elements being arranged in a first direction within a plane of the substrate, and a plurality of non-fed elements provided to sandwich at least one of the plurality of fed elements in the first direction, the plurality of non-fed elements being loaded to the plurality of fed elements. At least one of the plurality of non-fed elements is provided between two of the plurality of fed elements arranged in the first direction, the at least one of the plurality of non-fed elements being shared by the two of the plurality of fed elements that are adjacent to each other in the first direction.

Since one non-fed element is shared by two fed elements, the total number of driven and non-fed elements can be reduced. This helps achieve miniaturization of the array antenna. Only one non-fed element needs to be provided between two fed elements. This configuration helps reduce the spacing of fed elements in comparison to disposing, between two fed elements, two non-fed elements, each loaded to the corresponding fed element. This results in increased beam scanning angle when the array antenna is operated as a phased antenna.

According to a second aspect of the present disclosure, in addition to the features of the array antenna according to the first aspect, the array antenna further includes a plurality of feed lines provided to the plurality of fed elements, respectively, each of the plurality of feed lines feeding power to the corresponding fed element. A feed point in which each of the plurality of feed line feeds power to each corresponding fed element is positioned to excite the corresponding fed element in a direction orthogonal to the first direction.

When radio frequency signals are applied to individual fed elements, the fed elements are excited in a direction orthogonal to the first direction in which the fed elements are arranged.

According to a third aspect of the present disclosure, in addition to the features of the array antenna according to the first or second aspect, a dimension of the plurality of fed elements, a dimension of the plurality of non-fed elements, and a relative position of the plurality of fed elements and the plurality of non-fed elements are each designed such that each of the plurality of fed elements and at least two of the plurality of non-fed elements located on each side of the plurality of fed elements generate multi-resonance to provide an operating band width greater than an operating band width provided by one of the plurality of fed element.

Employing the above-mentioned configuration helps achieve increased band width of the array antenna.

According to a fourth aspect of the present disclosure, in addition to the features of the array antenna according to the first to third aspects, the plurality of fed elements are further arranged in a second direction orthogonal to the first direction to form a matrix arrangement as a whole, and at least one of the plurality of non-fed elements is provided between two of the plurality of fed elements arranged in the second direction, the at least one non-fed element being shared by the two of the plurality of fed elements that are adjacent to each other in the second direction.

The above-mentioned configuration helps reduce the dimensions of the array antenna two-dimensionally. Further, this configuration also makes it possible to steer the direction of main-beam radiation two-dimensionally.

Since one non-fed element is shared by two fed elements, the total number of driven and non-fed elements can be reduced. This helps achieve miniaturization of the array antenna. Only one non-fed element needs to be provided between two fed elements. This configuration helps reduce the spacing of fed elements in comparison to disposing, between two fed elements, two non-fed elements, each loaded to the corresponding fed element. This results in increased beam scanning angle of the array antenna when used as a phase array antenna.

DETAILED DESCRIPTION

The structure of an array antenna according to an embodiment of the disclosure will be described with reference to FIGS. 1, 2A, and 2B.

Figure 1:
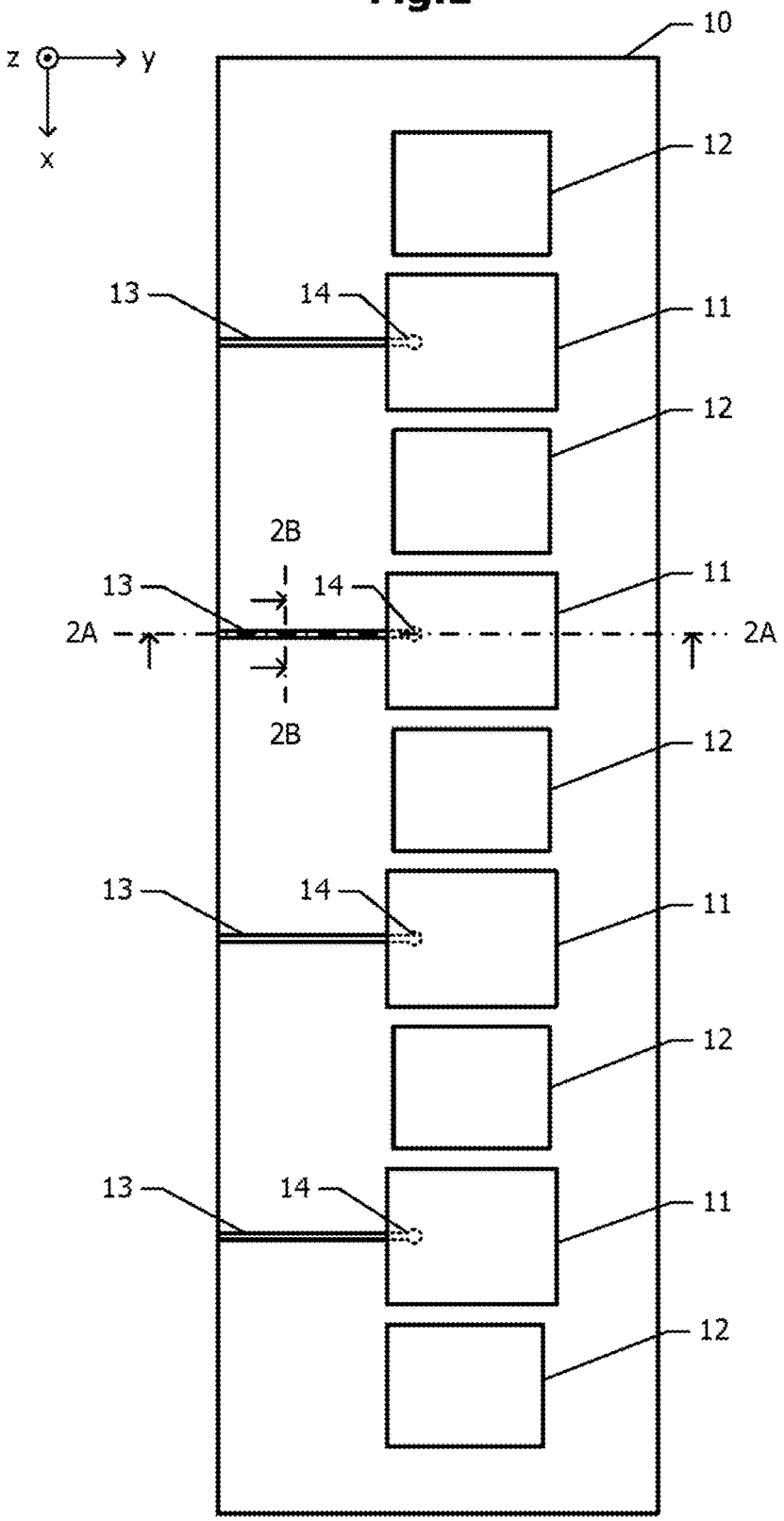
FIG. 1 is a plan view of an array antenna according to an embodiment.

FIG. 1 is a plan view of the array antenna according to the embodiment. Plural fed elements 11 are provided on a substrate 10. Although FIG. 1 illustrates an example with four fed elements 11, the number of fed elements 11 may be two or three, or five or more. The fed elements 11 are arranged in a first direction within the plane of the substrate 10. An x-y-z orthogonal coordinate system is defined, with the x-direction being the first direction and the z-direction being a direction normal to the substrate 10.

Two non-fed elements 12 are loaded to each fed element 11. The two non-fed elements 12 are provided to sandwich the fed element 11 to which the two non-fed elements 12 are to be loaded. The fed elements 11 and the non-fed elements 12 are each formed by a single conductor pattern. Each one non-fed element 12 is provided between the fed elements 11 arranged in the x-direction. The one non-fed element 12 is shared by two fed elements 11 that are adjacent to each other in the x-direction. In other words, each non-fed element 12 is loaded to both the fed element 11 located on the positive side of the x-direction of the non-fed element 12 and the fed element 11 located on the negative side of the x-direction of the non-fed element 12.

One fed element 11, and two non-fed elements 12 provided on the positive and negative sides of the x-direction of the one fed element 11 can be regarded as constituting each individual patch antenna. In other words, plural patch antennas are arranged in the x-direction, with the non-fed element 12 being shared by each two patch antennas.

A feed line 13 is provided to the fed element 11. The feed line 13 is connected to the corresponding fed element 11 at a feed point 14. The feed line 13 extends from the feed point 14 in the negative direction of the y-axis. Power is fed to the fed element 11 via the feed line 13. In the example illustrated in FIG. 1, the feed point 14 is positioned offset in the y-direction from the center of the fed element 11. According to this configuration, the fed element 11 is excited in the y-direction.

Figure 2A:
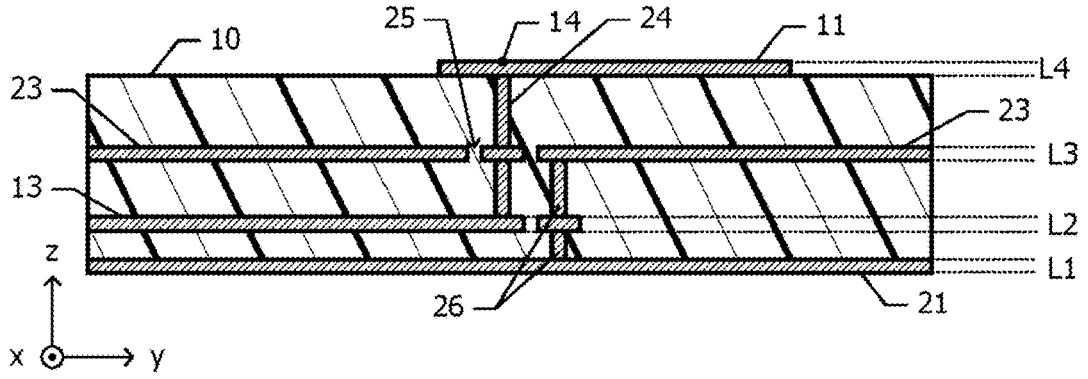
FIGS. 2A and 2B are cross-sectional views respectively taken along an alternate long and short dash line 2A-2A and an alternate long and short dash line 2B-2B in FIG. 1.
Figure 2B:
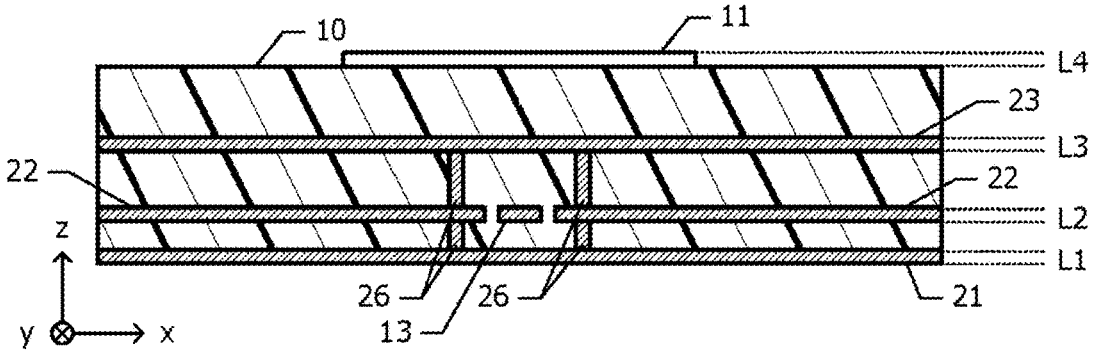

FIGS. 2A and 2B are cross-sectional views respectively taken along an alternate long and short dash line 2A-2A and an alternate long and short dash line 2B-2B in FIG. 1. Four conductor layers are provided on the surface and in the interior of the substrate 10 formed by a dielectric. A conductor layer L1, which is the lowermost layer, is provided on the bottom face of the substrate 10. A conductor layer L4, which is the uppermost layer, is provided on the top face of the substrate 10. Conductor layers L2 and L3, which are respectively at the second and third levels from the bottom, are provided in the interior of the substrate 10.

A ground conductor 21 is provided in the lowermost conductor layer L1. The feed line 13 is provided in the conductor layer L2 at the second level. A ground conductor 22 is provided on both sides (the positive and negative sides of the x-direction) of the feed line 13 extending in the y-direction.

A ground conductor 23 is provided in the conductor layer L3 at the third level. The distal end of the feed line 13 and the feed point 14 of the fed element 11 are connected to each other by an inter-layer connection conductor 24. The inter-layer connection conductor 24 passes through a cavity 25 provided in the ground conductor 23 so that the inter-layer connection conductor 24 is insulated from the ground conductor 23. The inter-layer connection conductor 24 includes a conductor post provided between the conductor layers L2 and L3, a land provided in the conductor layer L3, and a conductor post provided between the conductor layers L3 and L4.

In plan view, the feed line 13 is surrounded by a conductor wall 26. The conductor wall 26 includes plural conductor posts provided between the conductor layers L1 and L2, and plural conductor posts provided between the conductor layers L2 and L3. The conductor wall 26 prevents interference between plural feed lines 13. The lowermost ground conductor 21 and the feed line 13 form a microstrip line with a characteristic impedance of 50Ω. The ground conductor 23 in the layer at the third level serves to reduce electromagnetic coupling between the feed line 13 and the fed element 11.

The following describes exemplary dimensions and materials of various portions of the array antenna according to the embodiment when the array antenna is operated at the 60 GHz band. The conductor portion provided in each of the conductor layers L1, L2, L3, and L4 is made of copper. The substrate 10 is made of, for example, a ceramic material with a relative dielectric constant of approximately 3.5.

The conductor portion provided in each of the conductor layers L1, L2, L3, and L4 has a thickness of approximately 0.015 mm. The dielectric layer between the lowermost conductor layer L1 and the conductor layer L2 at the second level has a thickness of 0.06 mm. The dielectric layer between the conductor layer L2 at the second level and the conductor layer L3 at the third level has a thickness of 0.12 mm. The dielectric layer between the conductor layer L3 at the third level and the uppermost conductor layer L4 has a thickness of 0.15 mm. The separation between the feed line 13 and the ground conductor 22, and the width of the feed line 13 are both 0.05 mm.

The respective planar dimensions and relative positions of the fed elements 11 and non-fed elements 12 are designed such that each fed element 11 and the non-fed elements 12 located on both sides of the fed element 11 generate multi-resonance to provide an operating band width greater than the operating band width provided by each fed element 11 alone.

Next, the advantages of the array antenna according to the embodiment will be described. According to the embodiment, the non-fed element 12 is loaded to each fed element 11, and multi-resonance is generated by the fed element 11 and the non-fed element 12 to achieve increased band width. Since one non-fed element 12 is shared by two fed elements 11, the number of non-fed elements 12 can be reduced. This helps achieve miniaturization of the array antenna.

If the non-fed element 12 is not shared by two fed elements 11, the resulting configuration is such that between two fed elements 11, two non-fed elements 12, one loaded to one of the fed elements 11 and the other loaded to the other fed element 11, need to be provided individually. Since two non-fed elements 12 are provided between the fed elements 11 in this case, the length from one end of the array antenna to the other end increases. By contrast, employing the configuration according to the embodiment makes it possible to reduce the length of the array antenna.

Further, the embodiment helps reduce the spacing of the fed elements 11. Such reduced element spacing allows the array antenna to have a wider beam scanning angle when operated as a phased array antenna.

To verify the superior characteristics of the above-mentioned array antenna according to the embodiment, antenna characteristics are simulated for antennas according to various reference examples, and for the array antenna according to the embodiment. The simulation results will be described below with reference to FIGS. 3 to 10C. The antennas according to reference examples and the embodiment that are subject to simulation, each has a layer structure identical to the layer structure of the array antenna according to the embodiment illustrated in FIG. 2A and FIG. 2B.

Figure 3:
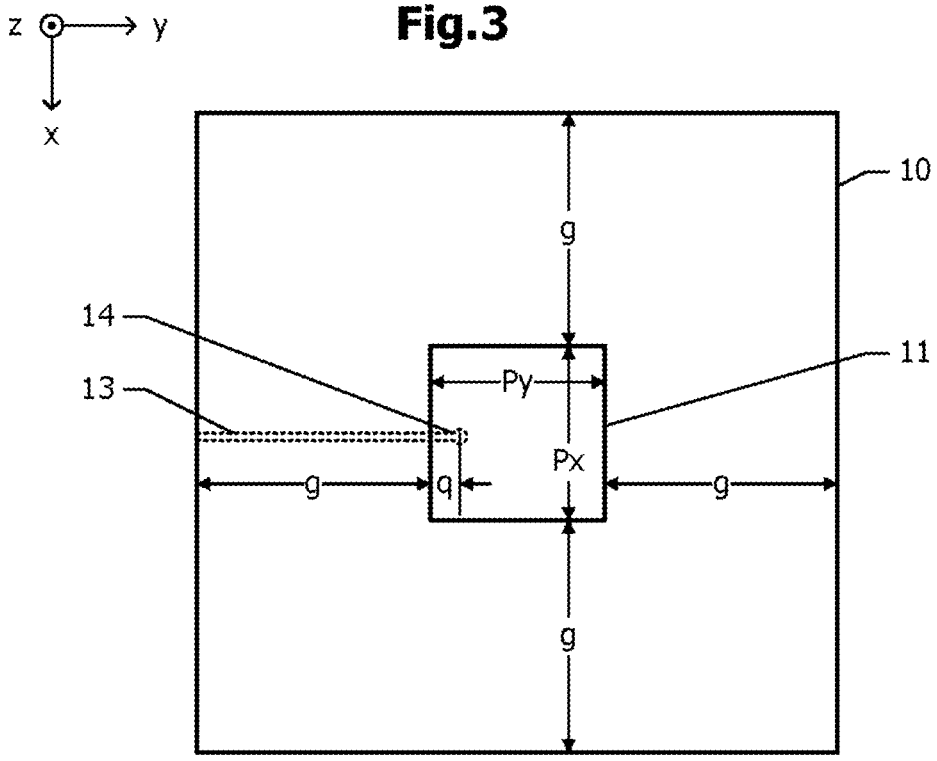
FIG. 3 is a plan view of a patch antenna according to Reference Example 1 that is subject to simulation.

FIG. 3 is a plan view of a patch antenna according to Reference Example 1. A single fed element 11 is provided on the surface of the substrate 10. The fed element 11 is loaded with no non-fed element. Although FIG. 3 depicts only the uppermost conductor layer L4 (FIGS. 2A and 2B) and the feed line 13, the ground conductors 21, 22, and 23, and the conductor wall 26 (FIGS. 2A and 2B) are provided in the interior of the substrate 10.

The planar shape of each of the fed element 11 and the substrate 10 is a square. One side of the square is parallel to the x-direction. The fed element 11 has a dimension Px in the x-direction and a dimension Py in the y-direction that are both 1.21 mm. The planar shape of the substrate 10 is also a square, and the distance g from the edge of the fed element 11 to the edge of the substrate 10 is 0.46 mm. The feed point 14 is positioned offset in the negative direction of the y-axis from the center of the fed element 11. The feed line 13 is extended in the negative direction of the y-axis from the feed point 14. The distance q from the edge on the negative side of the y-axis of the fed element 11 to the feed point 14 is 0.46 mm. These dimensions are determined in such a way to provide a resonant frequency of 60 GHz.

Figure 4A:
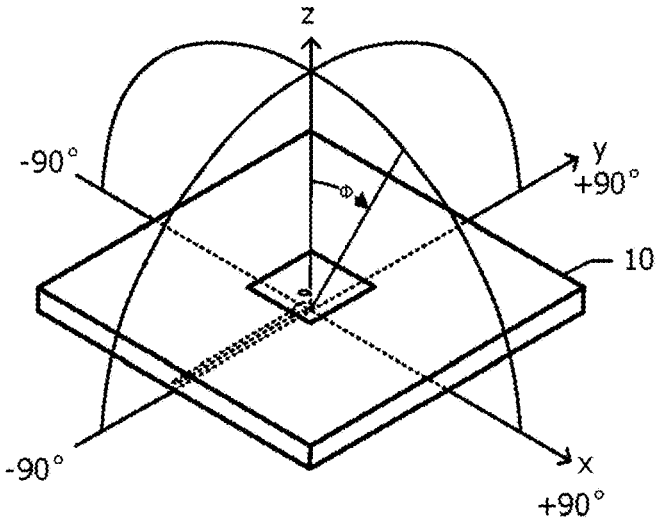
FIG. 4A is a perspective view of a coordinate system for explaining the definition of the sign of polar angle used for simulation.

FIG. 4A illustrates a coordinate system used for simulation. The direction normal to the substrate 10 corresponds to the z-direction. The polar angle Φ representing the angle of inclination in each of the positive x-axis and y-axis directions from the normal direction is defined as positive, and the polar angle Φ representing the angle of inclination in each of the negative x-axis and y-axis directions from the normal direction is defined as negative.

Figure 4B:
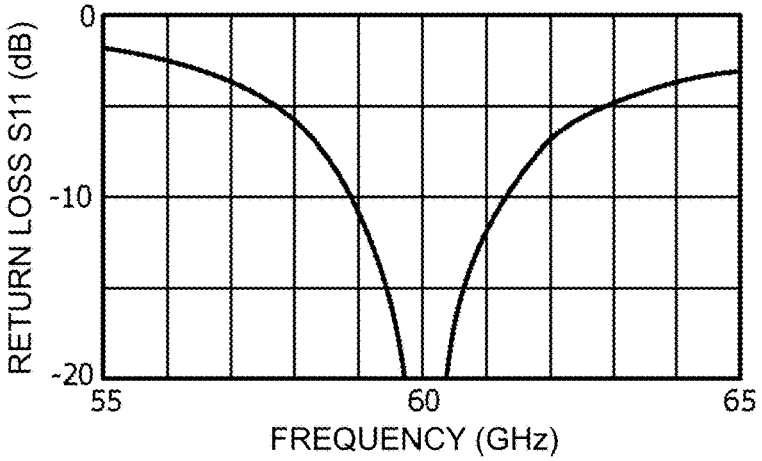
FIGS. 4B and 4C are graphs respectively illustrating simulated return loss and simulated radiation pattern of the patch antenna according to Reference Example 1.

FIG. 4B illustrates simulated return loss of the patch antenna according to Reference Example 1. The horizontal axis represents frequency in units of "GHz", and the vertical axis represents return loss S11 in units of "dB". The band width over which the return loss S11 is −10 dB or lower is approximately 2.22 GHz. This gives a band width ratio of 3.7% because the center frequency is 60 GHz.

Figure 4C:
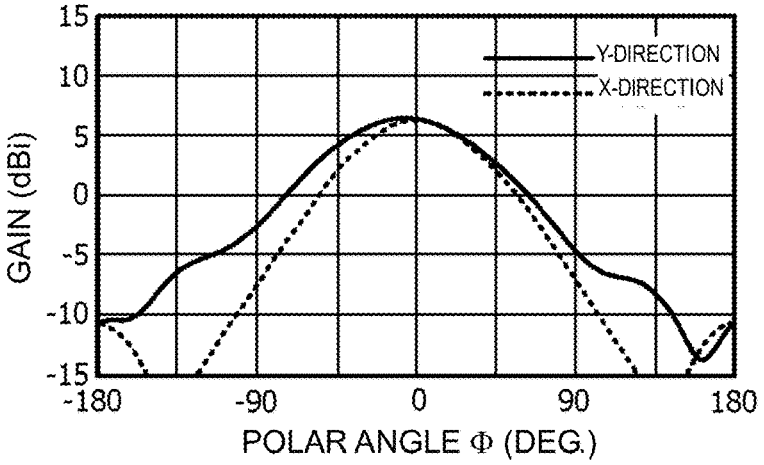

FIG. 4C illustrates simulated radiation pattern. The horizontal axis represents polar angle Φ in units of "degree", and the vertical axis represents gain in units of "dBi". The solid line in FIG. 4C represents gain in the direction of inclination toward each of the positive and negative sides of the y-axis from the normal direction, and the broken line represents gain in the direction of inclination toward each of the positive and negative sides of the x-axis from the normal direction. A gain of 5 dBi or more is obtained for the frontal direction of the patch antenna (the direction normal to the substrate 10).

Figure 5:
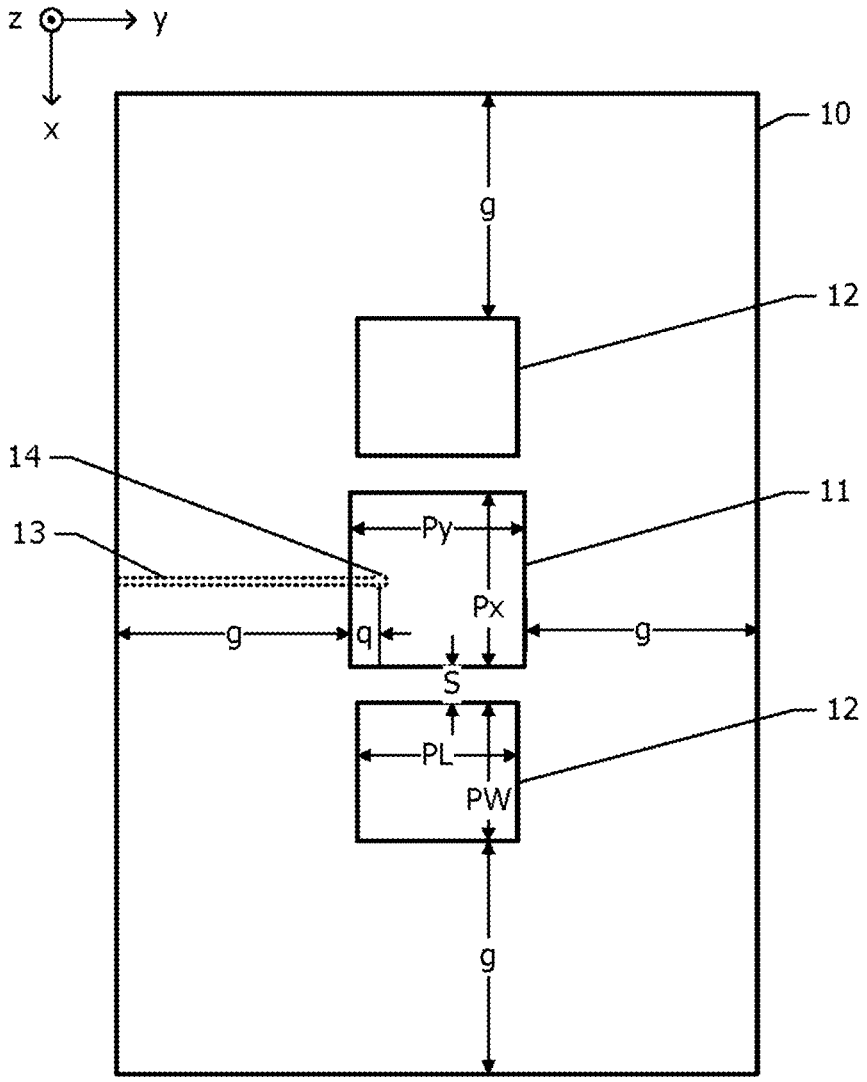
FIG. 5 is a plan view of a patch antenna according to Reference Example 2 that is subject to simulation.

FIG. 5 is a plan view of a patch antenna according to Reference Example 2. The following description will focus on differences from Reference Example 1 illustrated in FIG. 3, and features identical to those of Reference 1 will not be described again in great detail. The non-fed element 12 is provided on each of the positive and negative sides of the x-direction of the fed element 11. The planar shape of each of the fed element 11, the non-fed element 12, and the substrate 10 is a rectangle with one side parallel to the x-direction.

The fed element 11 has a dimension Px in the x-direction of 1.05 mm, and a dimension Py in the y-direction of 1.25 mm. Each non-fed element 12 has a dimension PW in the x-direction of 0.8 mm, and a dimension PL in the y-direction of 1.2 mm. The fed element 11 and the non-fed element 12 have a spacing S of 0.2 mm from each other. The distance q from the edge on the negative side of the y-axis of the fed element 11 to the feed point 14 is 0.37 mm. The distance g from the edge of the fed element 11 parallel to the x-axis to the edge of the substrate 10, and the distance g from the edge of the non-fed element 12 parallel to the y-axis to the edge of the substrate 10 are 2.0 mm. These dimensions are determined in such a way to provide a resonant frequency of 60 GHz.

Figure 6A:
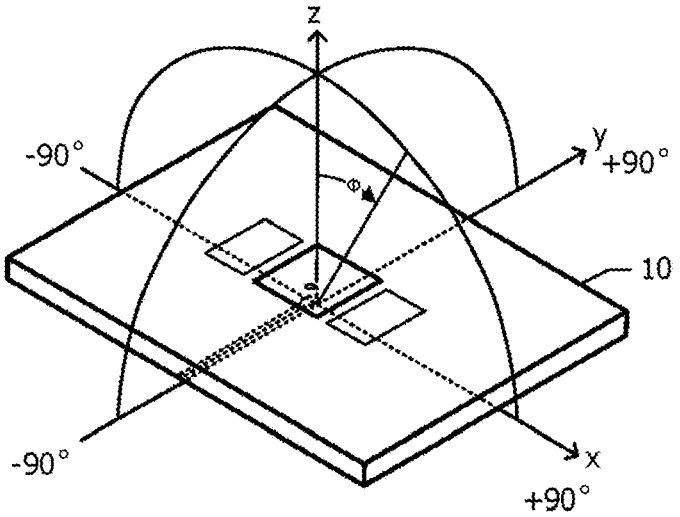
FIG. 6A is a perspective view of a coordinate system for explaining the definition of the sign of polar angle used for simulation.

FIG. 6A illustrates a coordinate system used for simulation. The definition of the sign of polar angle Φ is the same as in Reference Example 1 illustrated in FIG. 4A.

Figure 6B:
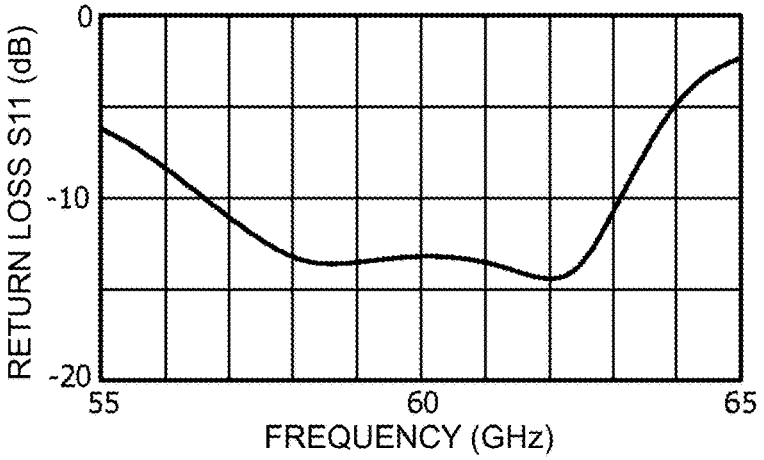
FIGS. 6B and 6C are graphs respectively illustrating simulated return loss and simulated radiation pattern of the patch antenna according to Reference Example 2.

FIG. 6B illustrates simulated return loss of the patch antenna according to Reference Example 2. The horizontal axis represents frequency in units of "GHz", and the vertical axis represents return loss S11 in units of "dB". The band width over which the return loss S11 is −10 dB or lower is approximately 6.48 GHz. This gives a band width ratio of 10.8% because the center frequency is 60 GHz. It can be appreciated that increased band width is achieved in comparison to the patch antenna according to Reference Example 1 illustrated in FIG. 4B. The increased band width is achieved by multi-resonance between the fed element 11 and the non-fed element 12.

Figure 6C:
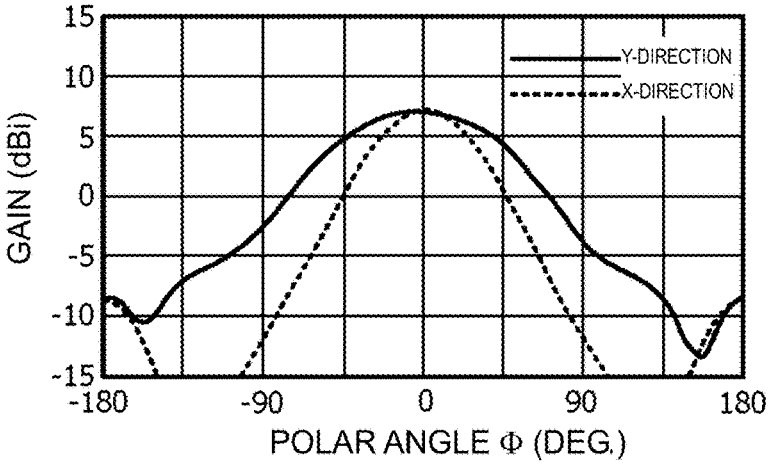

FIG. 6C illustrates simulated radiation pattern. The horizontal axis represents polar angle Φ in units of "degree", and the vertical axis represents gain in units of "dBi". The solid line in FIG. 6C represents gain in the direction of inclination toward each of the positive and negative sides of the y-axis from the normal direction, and the broken line represents gain in the direction of inclination toward each of the positive and negative sides of the x-axis from the normal direction. A gain of 5 dBi or more is obtained for the frontal direction of the patch antenna (the direction normal to the substrate 10).

Figure 7:
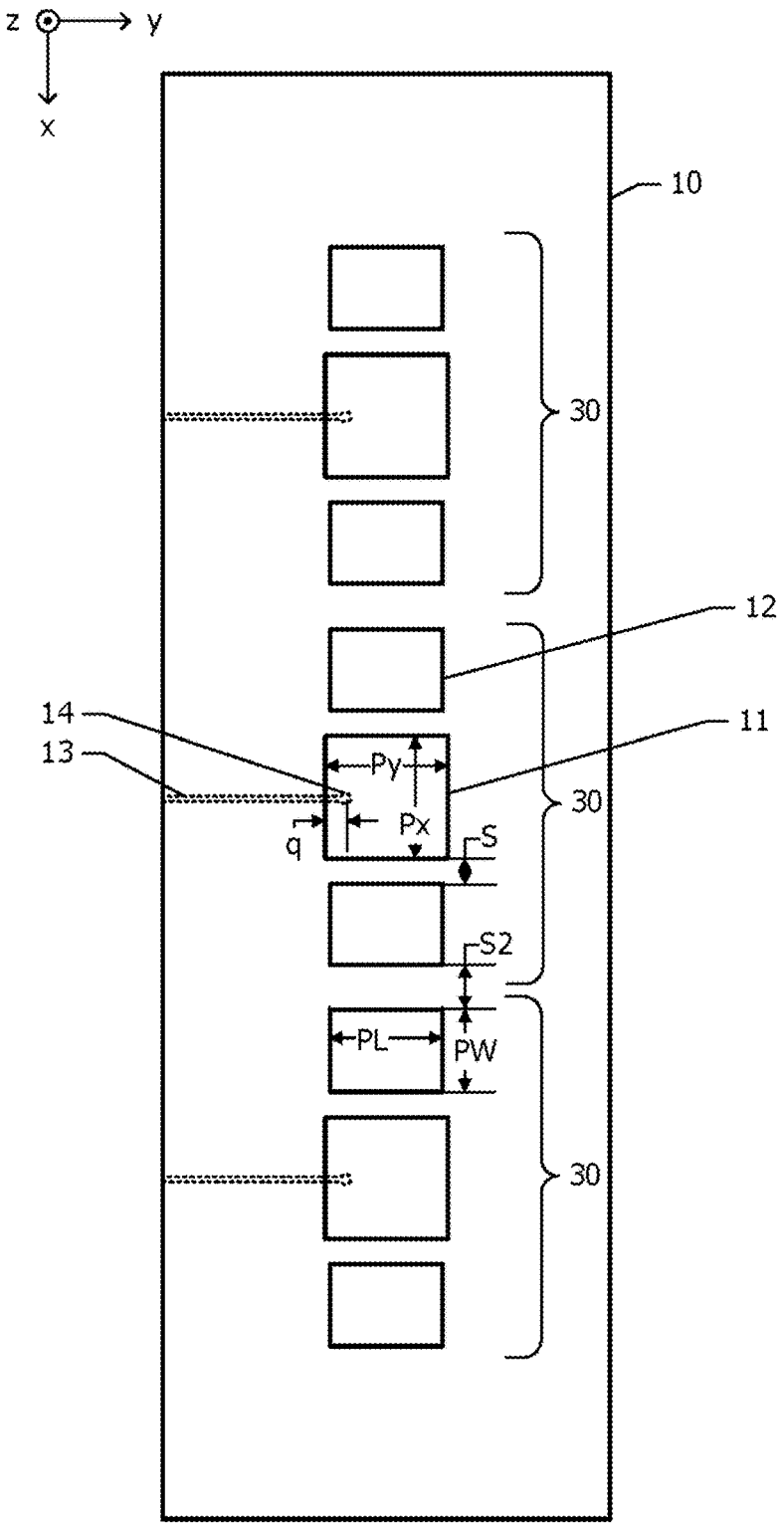
FIG. 7 is a plan view of a patch antenna according to Reference Example 3 that is subject to simulation.

FIG. 7 is a plan view of a patch antenna array according to Reference Example 3. The following description will focus on differences from Reference Example 2 illustrated in FIG. 5, and features identical to those of Reference 2 will not be described again in great detail. In Reference Example 3, three individual patch antennas 30 are arranged in the x-direction. Each patch antenna 30 is identical in configuration to the patch antenna according to Reference Example 2 illustrated in FIG. 5, and differs only in some of its dimensions.

The dimension Px in the x-direction of the fed element 11, the dimension Py in the y-direction of the fed element 11, and the spacing S between the fed element 11 and the non-fed element 12 are the same as those of the patch antenna according to Reference Example 2 illustrated in FIG. 5. The distance q from the edge on the negative side of the y-axis of the fed element 11 to the feed point 14 is 0.4 mm. Each non-fed element 12 has a dimension PW in the x-direction of 0.70 mm, and a dimension PL in the y-direction of 1.18 mm. The spacing S2 between two adjacent non-fed elements 12 is 0.45 mm.

Figure 8A:
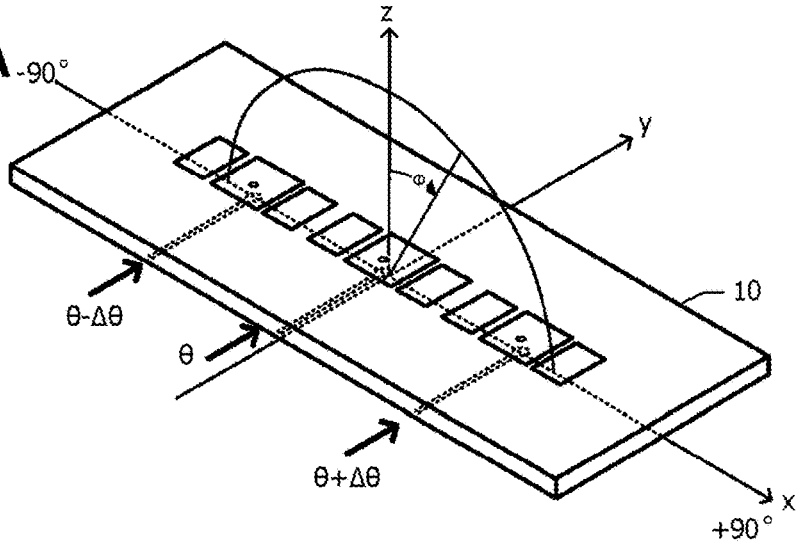
FIG. 8A is a perspective view of a coordinate system for explaining the definition of the sign of polar angle used for simulation.

FIG. 8A illustrates a coordinate system used for simulation. The polar angle Φ representing the angle of inclination in the positive direction of the x-axis from the direction normal to the substrate is defined as positive, and the polar angle Φ representing the angle of inclination in the negative direction of the x-axis is defined as negative.

Figure 8B:
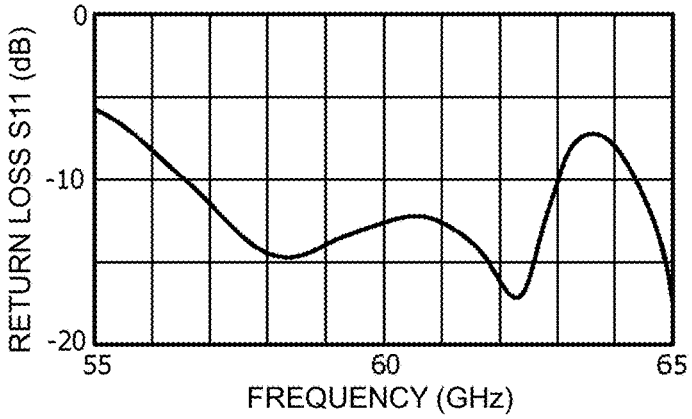
FIGS. 8B and 8C are graphs respectively illustrating simulated return loss and simulated radiation pattern of the patch antenna according to Reference Example 3.

FIG. 8B illustrates simulated return loss of the patch antenna array according to Reference Example 3. The horizontal axis represents frequency in units of "GHz", and the vertical axis represents return loss S11 in units of "dB". The band width over which the return loss S11 is −10 dB or lower is approximately 6.42 GHz. This gives a band width ratio of 10.7% because the center frequency is 60 GHz. It can be appreciated that increased band width equivalent to that of the patch antenna according to Reference Example 2 illustrated in FIG. 6B is achieved.

Figure 8C:
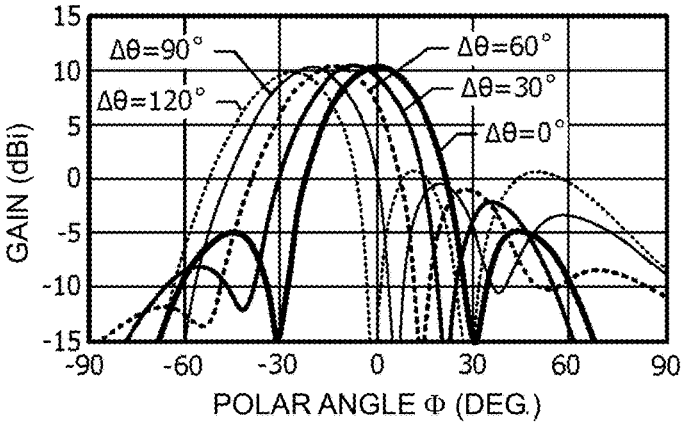

FIG. 8C illustrates simulated radiation pattern. The horizontal axis represents polar angle Φ in units of "degree", and the vertical axis represents gain in units of "dBi". In this simulation, with reference to the phase θ of a radio frequency signal applied to the fed element 11 in the middle, the phase of a radio frequency signal applied to the fed element 11 located on the positive side of the x-axis is advanced by Δθ, and the phase of a radio frequency signal applied to the fed element 11 located on the negative side of the x-axis is delayed by Δθ. Curved lines in FIG. 8C represent respective gains obtained for phase differences Δθ of 0°, 30°, 60°, 90°, and 120°. The steering angle of the main beam is approximately 26° when the phase difference between radio frequency signals is set to 120°.

Figure 9:
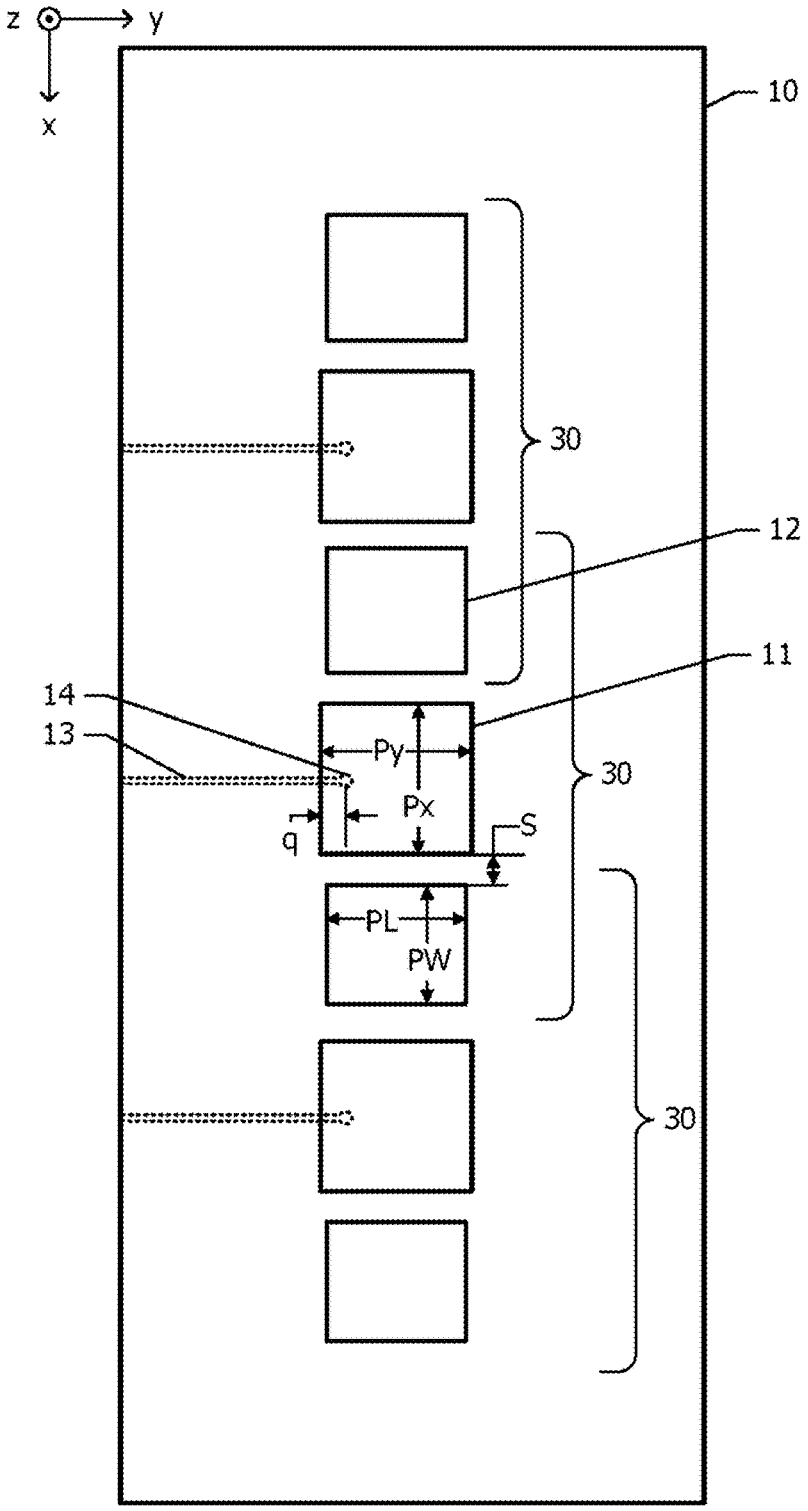
FIG. 9 is a plan view of a patch antenna according to the embodiment that is subject to simulation.

FIG. 9 is a plan view of a patch antenna array according to the embodiment. The following description will focus on differences from Reference Example 3 illustrated in FIG. 7, and features identical to those of Reference 3 will not be described again in great detail. In the embodiment as well, three individual patch antennas 30 are arranged in the x-direction. In the embodiment, the non-fed element 12 is shared by two patch antennas 30.

The fed element 11 has a dimension Px in the x-direction of 0.9 mm, and a dimension Py in the y-direction of 1.26 mm. Each non-fed element 12 has a dimension PW in the x-direction of 0.87 mm, and a dimension PL in the y-direction of 1.21 mm. The fed element 11 and the non-fed element 12 have a spacing S of 0.27 mm from each other. The distance q from the edge on the negative side of the y-axis of the fed element 11 to the feed point 14 is 0.44 mm. These dimensions are determined in such a way to provide a resonant frequency of 60 GHz.

Figure 10A:
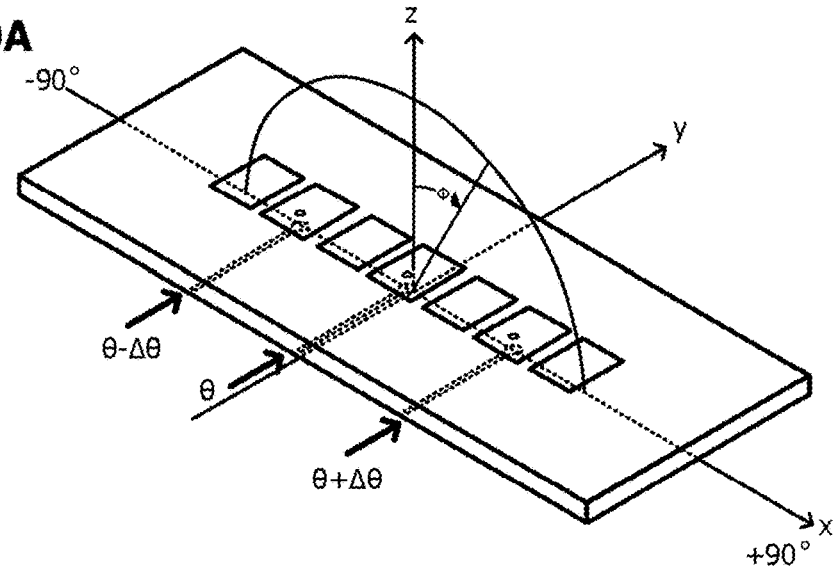
FIG. 10A is a perspective view of a coordinate system for explaining the definition of the sign of polar angle used for simulation.

FIG. 10A illustrates a coordinate system used for simulation. The definition of the sign of polar angle Φ is the same as in Reference Example 3 illustrated in FIG. 8A.

Figure 10B:
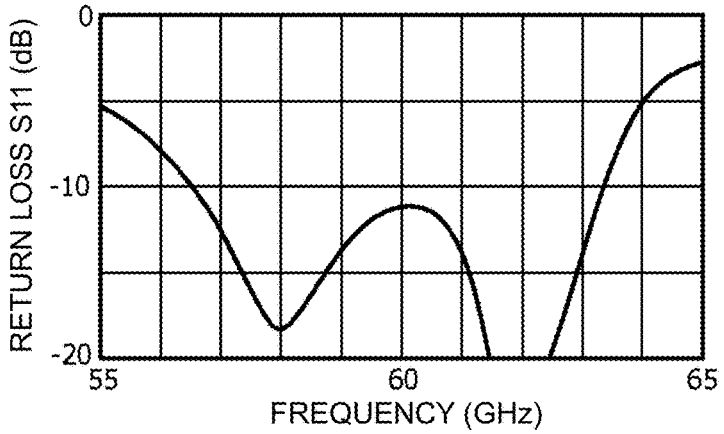
FIGS. 10B and 10C are graphs respectively illustrating simulated return loss and simulated radiation pattern of the patch antenna according to the embodiment.

FIG. 10B illustrates simulated return loss of the patch antenna array according to the embodiment. The horizontal axis represents frequency in units of "GHz", and the vertical axis represents return loss S11 in units of "dB". The band width over which the return loss S11 is −10 dB or lower is approximately 6.72 GHz. This gives a band width ratio of 11.2% because the center frequency is 60 GHz. It can be appreciated that increased band width equivalent to that of the patch antenna according to Reference Example 3 illustrated in FIG. 8B is achieved.

Figure 10C:
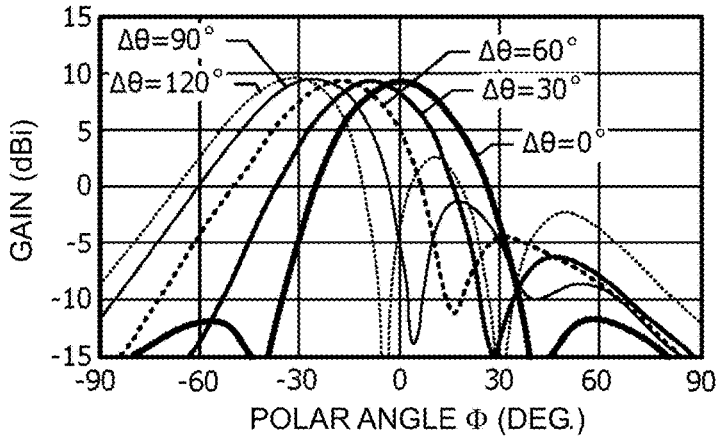

FIG. 10C illustrates simulated radiation pattern. The horizontal axis represents polar angle Φ in units of "degree", and the vertical axis represents gain in units of "dBi". Radio frequency signals are applied to three fed elements 11 in the same phase relationship as with the simulation results illustrated in FIG. 8C. The curved lines in FIG. 10C represent respective gains obtained for phase differences Δθ of 0°, 30°, 60°, 90°, and 120°. The steering angle of the main beam is approximately 32° when the phase difference between radio frequency signals is set to 120°.

A comparison between FIG. 8C and FIG. 10C reveals that the array antenna according to the embodiment provides main beam steering angles greater than the main beam steering angles provided by the array antenna according to Reference 3. This is achieved by the reduced spacing of the dfed elements 11.

Further, the dimension from one end to the other end in the x-direction of the array antenna according to Reference Example 3 (FIG. 7) is 9.45 mm. By contrast, the dimension from one end to the other end in the x-direction of the array antenna according to the embodiment (FIG. 9) is 7.8 mm. This indicates that miniaturization of the array antenna is achieved by employing the configuration according to the embodiment.

Next, with reference to FIGS. 11A to 11D, the following description will explain why it is considered that the parasitic element 12 (FIG. 1) of the array antenna according to the embodiment is shared by two adjacent fed elements 11.

FIGS. 11A to 11D illustrate simulated distribution of current generated in the fed elements 11 and the parasitic elements 12. The array antenna under simulation is identical in configuration to the array antenna illustrated in FIG. 9. The different shades of gray in the figures represent the relative magnitude of current. Lighter shades correspond to areas where larger current flows.

Figure 11A:
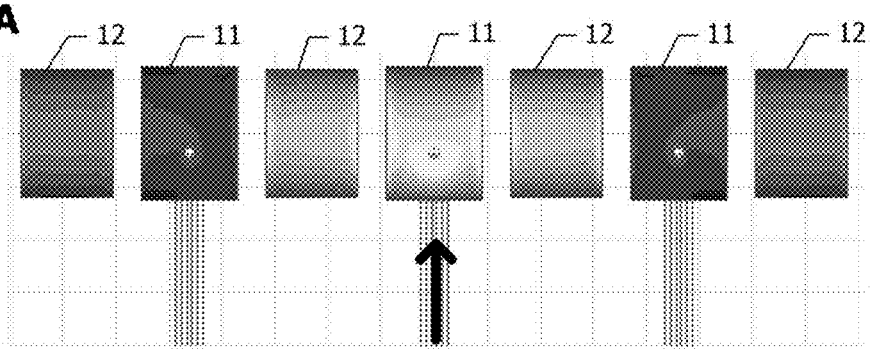
FIGS. 11A to 11D, each illustrates simulated distribution of current generated in driven and non-fed elements.
Figure 11B:
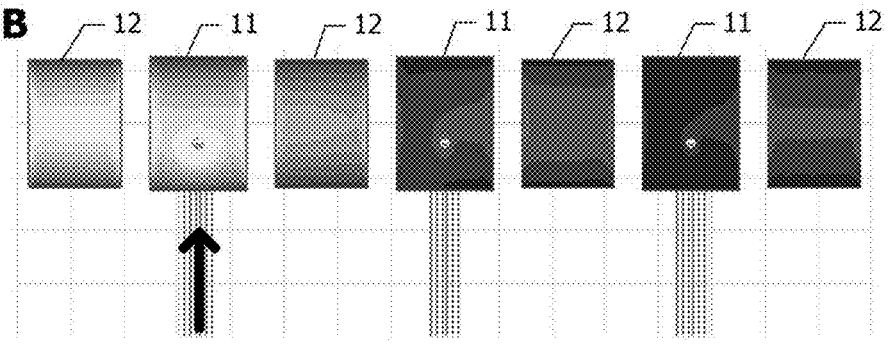
Figure 11C:
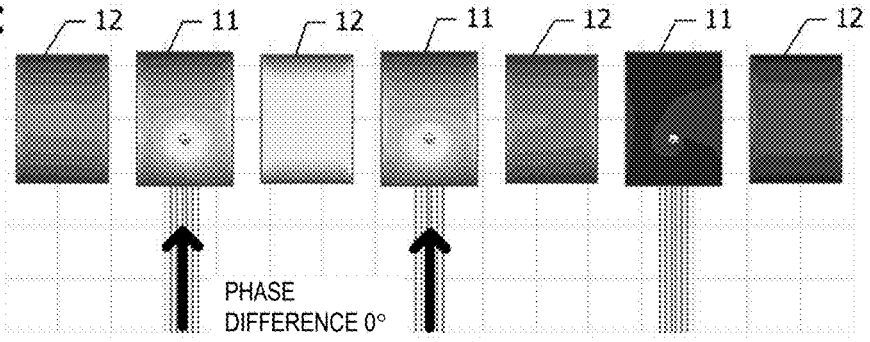
Figure 11D:
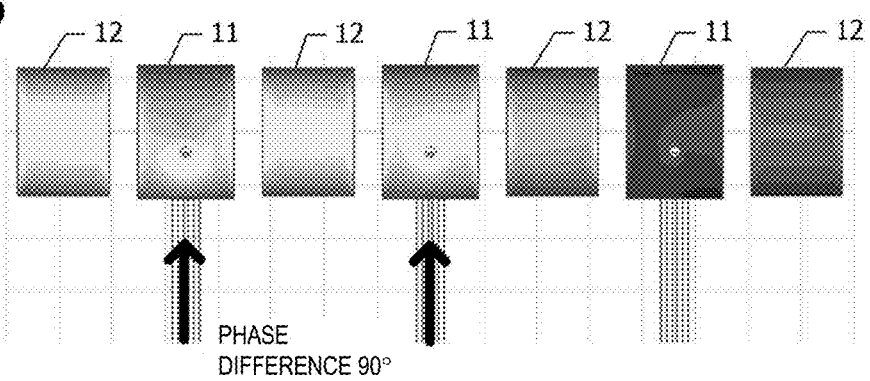

FIG. 11A illustrates the distribution of current when a radio frequency signal is applied to only the fed element 11 in the middle. FIG. 11B illustrates the distribution of current when a radio frequency signal is applied to only the fed element 11 on the left. FIG. 11C illustrates the distribution of current when radio frequency signals of the same phase are applied to the fed element 11 on the left and the fed element 11 in the middle. FIG. 11D illustrates the distribution of current when radio frequency signals with a phase difference of 90° are applied to the fed element 11 on the left and the fed element 11 in the middle. More specifically, the phase of the radio frequency signal applied to the fed element 11 on the left is delayed by 90° relative to the phase of the radio frequency signal applied to the fed element 11 in the middle.

When a radio frequency signal is applied to the fed element 11 in the middle (FIG. 11A), the strength of the current generated in the parasitic element 12 located between the fed element 11 on the left and the fed element 11 in the middle (to be referred to as "parasitic element 12 of interest" hereinafter) is approximately 90% of the strength of the current generated in the fed element 11 in the middle. When a radio frequency signal is applied to the fed element 11 on the left (FIG. 11B), the strength of the current generated in the parasitic element 12 of interest is approximately 70% of the strength of the current generated in the fed element 11 on the left.

It is thus confirmed that the parasitic element 12 of interest has been excited in both of the case when a radio frequency signal is applied to the fed element 11 in the middle and the case when a radio frequency signal is applied to the fed element 11 on the left. That is, it can be said that the parasitic element 12 of interest is loaded to the fed element 11 in the middle, and also loaded to the fed element 11 on the left.

When radio frequency signals of the same phase are applied to both the fed element 11 in the middle and the fed element 11 on the left (FIG. 11C), a larger current is generated in the parasitic element 12 of interest than when a radio frequency signal is applied to only one fed element (FIGS. 11A and 11B). These simulation results confirm that the parasitic element 12 of interest is shared by the fed element 11 in the middle and the fed element 11 on the left.

It can be appreciated that when a phase difference is given between the radio frequency signal applied to the fed element 11 in the middle and the radio frequency signal applied to the fed element 11 on the left (FIG. 11D), the strength of the current generated in the parasitic element 12 of interest decreases in comparison to when radio frequency signals of the same phase are applied (FIG. 11C). This is because the current generated in the parasitic element 12 due to the fed element 11 in the middle, and the current generated in the parasitic element 12 due to the fed element 11 on the left cancel each other out. It can be thus appreciated that the parasitic element 12 shared by two fed elements 11 acts as the parasitic element 12 loaded to each of the two fed elements 11, even when radio frequency signals with a phase difference are applied to the two fed elements 11.

Next, an array antenna according to another embodiment will be described with reference to FIG. 12. The following description will focus on differences from the embodiment illustrated in FIGS. 1, 2A, and 2B, and features identical to those of the above embodiment will not be described again in great detail.

Figure 12:
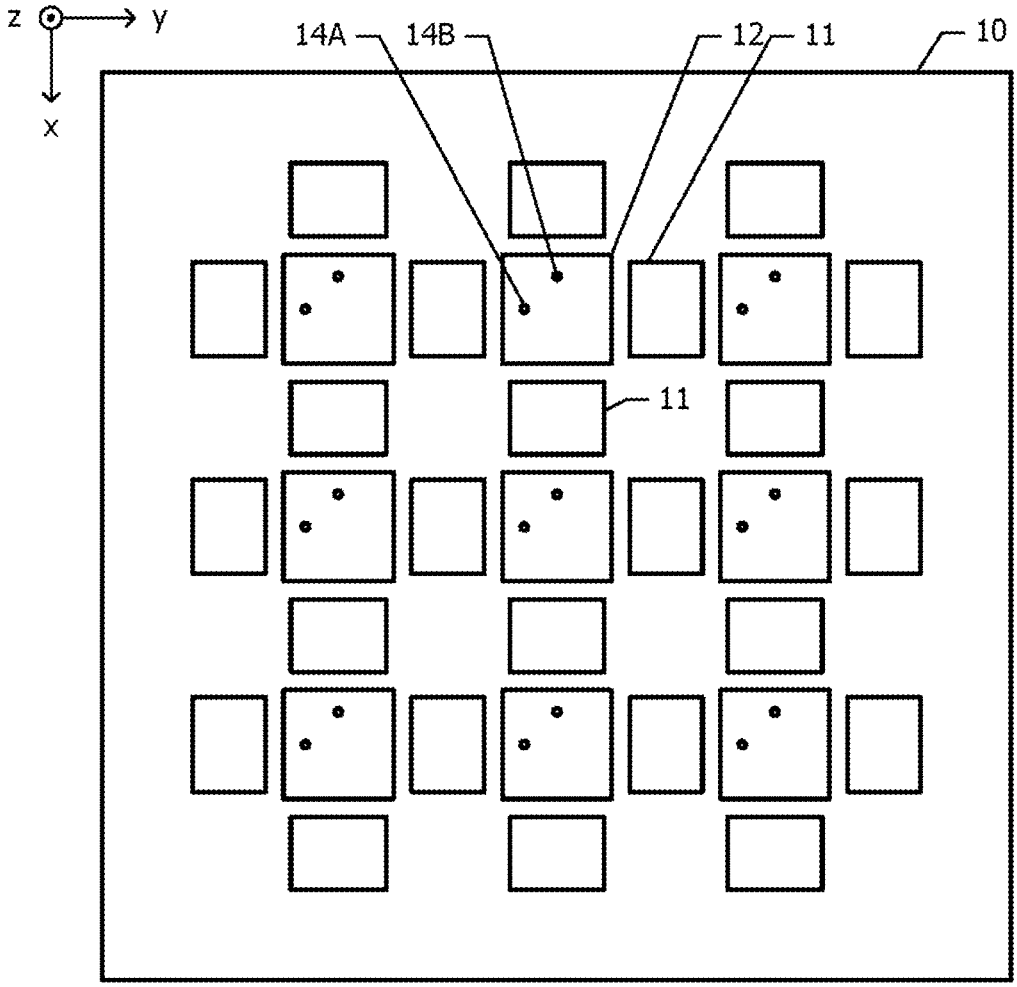
FIG. 12 is a plan view of an array antenna according to another embodiment.

FIG. 12 is a plan view of the array antenna according to this embodiment. Plural fed elements 11 are arranged not only in the x-direction but also in the y-direction to form a matrix arrangement as a whole. Each one parasitic element 12 is arranged not only between the fed elements 11 arranged in the x-direction but also between the fed elements 11 arranged in the y-direction. The one parasitic element 12 is shared by two fed elements 11 that are adjacent to each other in the y-direction.

Each fed element 11 is provided with two feed points 14A and 14B. The feed point 14A is positioned offset in the y-direction from the center of the fed element 11, and the other feed point 14B is positioned offset in the x-direction from the center of the fed element 11. By adjusting the phases of radio frequency signals applied to the two feed points 14A and 14B, it is possible to change the polarization of radiated radio waves.

As with the embodiment illustrated in FIGS. 1, 2A, and 2B, the embodiment illustrated in FIG. 12 also enables miniaturization of the array antenna. This miniaturization is achieved in two directions, the x-direction and the y-direction. Further, by operating the array antenna as a phased array antenna, it is possible to steer the main beam in each of the x- and y-directions, and also increase the steering angle.

It is needless to mention that the above embodiments are for illustrative purposes only, and various features or configurations described in different embodiments may be partially substituted for or combined with one another. For plural embodiments, the same or similar operational effects provided by the same or similar features or configurations will not be mentioned for each individual embodiment. Further, the present disclosure is not limited to the above-mentioned embodiments. For example, various modifications, improvements, or combinations will be apparent to those skilled in the art.

REFERENCE SIGNS LIST

10 substrate
11 fed element
12 parasitic element
13 feed line
14, 14A, 14B feed point
21, 22, 23 ground conductor
24 inter-layer connection conductor
25 cavity
26 conductor wall
30 patch antenna
L1, L2, L3, L4 conductor layer

The invention claimed is:

1. An array antenna comprising:

a plurality of fed patch antenna elements provided on or in a substrate, the plurality of fed patch antenna elements being arranged in a first direction, wherein the plurality of fed patch antenna elements are configured to be fed with power; and a plurality of non-fed patch antenna elements, wherein at least two of the non-fed patch antenna elements are provided adjacent opposing sides of at least one fed patch antenna element in the first direction so as to sandwich the at least one fed patch antenna element in the first direction, at least one of the non-fed patch antenna elements is provided between two of the fed patch antenna elements in the first direction, and the non-fed patch antenna elements are loaded to the fed patch antenna elements, wherein the at least one non-fed patch antenna element is shared by the two fed patch antenna elements, and wherein a dimension of the fed patch antenna elements, a dimension of the non-fed patch antenna elements, and a relative position of the fed patch antenna elements and the non-fed patch antenna elements are configured such that each of the fed patch antenna elements and non-fed patch antenna elements on opposing sides of the fed patch antenna elements are multi-resonant so as to have an operating bandwidth greater than an operating bandwidth provided by one of the fed patch antenna elements alone without non-fed patch antenna elements on opposing sides.

2. The array antenna according to claim 1, further comprising:

a plurality of feed lines each provided to a respective fed patch antenna element, the plurality of feed lines feeding power to the respective fed patch antenna element at a feed point, wherein the feed point is positioned to excite the corresponding fed patch antenna element in a direction orthogonal to the first direction.

3. The array antenna according to claim 1, wherein the fed patch antenna elements are further arranged in a second direction orthogonal to the first direction to form a matrix arrangement, and wherein at least one of the non-fed patch antenna elements is provided between two of the fed patch antenna elements in the second direction, and the at least one non-fed patch antenna element is shared by the two fed patch antenna elements in the second direction.

4. The array antenna according to claim 2, wherein the fed patch antenna elements are further arranged in a second direction orthogonal to the first direction to form a matrix arrangement, and wherein at least one of the non-fed patch antenna elements is provided between two of the fed patch antenna elements in the second direction, and the at least one non-fed patch antenna element is shared by the two fed patch antenna elements in the second direction.

* * * * *